US006767206B2

(12) United States Patent
Niemela et al.

(10) Patent No.: US 6,767,206 B2
(45) Date of Patent: Jul. 27, 2004

(54) ARRANGEMENT AND METHOD FOR HEATING GAS IN A GAS DUCT IN CONNECTION WITH CONTINUOUSLY OPERATED SINTERING

(75) Inventors: Pekka Niemela, Tornio (FI); Eero Väänänen, Tornio (FI); Jouko Pirttimaa, Tornio (FI); Olavi Tulkki, Tornio (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/363,872

(22) PCT Filed: Sep. 5, 2001

(86) PCT No.: PCT/FI01/00766

§ 371 (c)(1),
(2), (4) Date: Mar. 10, 2003

(87) PCT Pub. No.: WO02/23111

PCT Pub. Date: Mar. 21, 2002

(65) Prior Publication Data

US 2003/0165789 A1 Sep. 4, 2003

(30) Foreign Application Priority Data

Sep. 11, 2000 (FI) ..... 20001998

(51) Int. Cl.[7] ..... F23J 23/00

(52) U.S. Cl. ..... 432/152; 432/72; 432/199; 431/5

(58) Field of Search ..... 431/5; 432/13, 432/72, 176, 199, 219, 121, 144–152

(56) References Cited

U.S. PATENT DOCUMENTS

| | | | | |
|---|---|---|---|---|
| 2,512,326 A | | 6/1950 | Harrison | 263/19 |
| 2,750,274 A | | 6/1956 | Lellep | 75/5 |
| 2,945,755 A | | 7/1960 | Schulz et al. | 75/1 |
| 3,581,679 A | * | 6/1971 | Jansen et al. | 432/199 |
| 3,920,382 A | | 11/1975 | Hovis et al. | 432/209 |
| 3,947,001 A | | 3/1976 | Leighton | 266/20 |
| 4,332,551 A | | 6/1982 | Haslmayr et al. | 432/19 |
| 4,438,086 A | * | 3/1984 | Aramaki et al. | 423/448 |
| 4,767,320 A | * | 8/1988 | Sasaki et al. | 432/59 |
| 4,789,332 A | * | 12/1988 | Ramsey et al. | 432/59 |

* cited by examiner

*Primary Examiner*—Gregory Wilson
(74) *Attorney, Agent, or Firm*—Morgan & Finnegan, L.L.P.

(57) ABSTRACT

The invention relates to an arrangement and method for heating gases in a gas circulation duct in connection with continuously operated sintering. In the sintering furnace, hot gas is fed in from above the belt in order to sinter the material located on the belt, and part of the gas circulation duct is formed as a burning zone, a burner ring, where the gas is heated. The burner ring comprises at least one burner unit directed inwardly from the circumference of the gas circulation duct.

18 Claims, 3 Drawing Sheets

ARRANGEMENT AND METHOD FOR HEATING GAS IN A GAS DUCT IN CONNECTION WITH CONTINUOUSLY OPERATED SINTERING

FIELD OF THE INVENTION

The present invention relates to an arrangement and method for heating gases in a gas circulation duct, in connection with continuously operated sintering. In a sintering furnace, hot gas is fed in above the material bed located on the conveyor belt in order to sinter the material, and part of the gas duct is formed as a burning zone, a burner ring, where the gas is heated. The burner ring comprises at least one burner unit directed inwards from the edges of the burner ring.

DESCRIPTION OF THE RELATED ART

In continuously operated sintering, there is currently used a conveyor-type sintering device where a material bed is first formed on the conveyor belt. The material bed to be sintered is normally made of spherical pellets with a weak strength, or of ore finess, which is hardened by means of sintering, so that the pellets or the sinter can be further fed for instance to a smelting furnace without dust problems. Generally a sintering device includes separate zones for the drying, preheating and sintering of the material to be sintered, and for cooling the sintered product, and said successive steps are realized by conducting gas through the material bed and also through the conveyor belt. For example when processing ferroalloy pellets, hot gas is conducted in the sintering zone through the material bed and the belt, so that the bed temperature is raised up to the range of 1000–1600° C. At a high temperature, the pellets or the sinter react with the hot gas and are simultaneously hardened. The hardened pellets are cooled by conducting cooling gas through the material bed and the belt.

As was already pointed out, in the sintering device the thermal treatment of the material to be sintered is carried out by means of gas, by placing gas conduits around the sintering belt, in the immediate vicinity of said belt. Thus for instance for a cooling process that takes place at the final end of the belt, gas is fed in from underneath the belt, and gas is sucked from above the belt up to gas circulation ducts, where at least part of the gas is heated, and the heated gas is conducted to the first end of the belt, either to the drying, heating or sintering zone thereof.

The gas used in sintering is traditionally heated by means of separate combustion chambers arranged in the gas circulation duct, where along with the fuel, also the required combustion and spreading air is fed to the burner. The combustion chamber comprises one burner, in which case the adjusting of the temperature is difficult to realize. Normally the combustion chambers are placed in the vertical part of the duct, i.e. near to the surface to be sintered, in which case there are easily created local hot spots, which make it difficult to achieve a homogeneous sintering result. The hot spots also tend to cause damages to the equipment, for instance for the steel belt, the grate and the fireproof linings.

BRIEF SUMMARY OF THE INVENTION

The present invention relates to a method and arrangement for heating gases in a gas circulation duct in connection with continuously operated sintering. In a sintering furnace, hot gas is fed in from above the belt in order to sinter the material located on the belt, and part of the gas duct is formed as a combustion zone, a burner ring, where the gas is heated. At least in part of the gas circulation ducts, there is formed a burner ring, and a separate combustion chamber is not needed. A burner ring comprises at least one burner unit which is directed inwards from the edges of the burner ring, but generally the number of burner rings is at least two. Advantageously the burner units are located on the same circumference, and each unit includes feed ducts for one or several fuels. Each burner ring is provided with at least one ignition burner. When the fuel used for heating has been ignited by means of the ignition burner, there is no need for separately feeding in combustion air, but the combustion air is obtained from the gas contained in the gas circulation duct. By employing the burner ring, there is achieved an even temperature, and local temperature peaks are avoided. The essential novel features of the invention are apparent from the appended claims.

The burner ring according to the invention is advantageously constructed in the horizontal part of the gas circulation duct and sufficiently far from the bed to be sintered. When several burner units are used, there is obtained a large adjustment area that covers the temperature requirements during both the running-up period and normal operation. Generally the burner unit comprises, in addition to the fuel ducts of at least two different fuels, a flame guard, an ignition burner and an inspection opening. Combustion air must be fed separately only in the ignition burner, and the rest of the combustion air is obtained from the gas flowing in the gas duct. However, when several units are placed on one and the same circumference, it is not necessary to provide every unit with for instance a flame guard, ignition burner and inspection opening, but or example one ignition burner can take care of several units.

The interior of the gas circulation duct is made of a fireproof material. At the burner ring, there is advantageously made a small inwardly protuberance, i.e. a constriction. By means of the constriction, the gas flow in the duct is made turbulent, and simultaneously the fuel is mixed in the gas flow. Thus the constriction also evens out the temperature on different sides of the duct, and an even temperature is obtained above the bed to be sintered.

Ignition burners are provided for example with hydraulic control and automatics, so that they are in the gas duct with the flame on only until a given temperature is reached, whereafter the flame is extinguished and they are drawn in, to the protection of the duct masonry and other structures. This means a remarkable increase in the working age of the ignition burners. In the control function, also electricity or pressurized air can naturally be used.

BRIEF DESCRIPTION OF THE DRAWINGS

The arrangement according to the invention is described in more detail with reference to the appended drawings, where.

DETAILED DESCRIPTION

Figure 1:
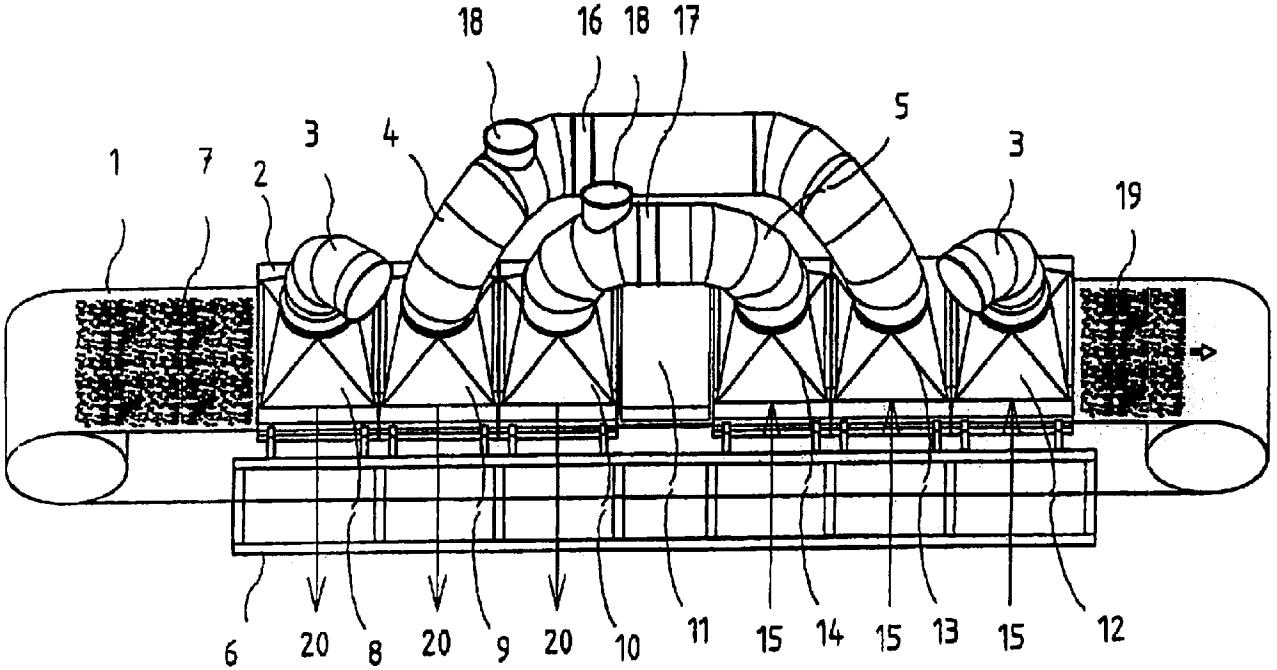
FIG. 1 illustrates the principle of the sintering arrangement.

According to FIG. 1, the sintering arrangement comprises a sintering belt 1 rotating around drums arranged at both ends (not illustrated in more detail), a sintering furnace 2 and gas circulation ducts 3, 4 and 5 connected to the furnace. The outermost gas duct 3 is illustrated only in part. The sintering arrangement also comprises a support structure 6. The material to be sintered is fed as a bed 7 onto the sintering belt. The material to be sintered proceeds in the furnace first through the drying zone 8 and the preheating zone 9, and moves then to the sintering zone 10 comprising one or more parts. After the sintering zone, the arrangement is often provided with a stabilizing zone 11, whereafter there follows a cooling zone including several steps.

Gas is first conducted to the sintering arrangement, to several compartments 12, 13 and 14 of the cooling zone, via the gas conduits 15. The gas conduits are connected to one or several blowers (not illustrated). When the gas has passed through the sintering belt and the bed located thereon, it is sucked from each compartment to its own gas duct 3, 4 and 5. The gas exhausted from the outermost cooling channel 12 (seen in the flowing direction of the material to be sintered) is conducted to the drying zone 8, and said gas duct 3 is not normally provided with a burner ring. On the other hand, from the cooling compartments 13 and 14, located nearer to the middle part of the arrangement, gas is conducted to the gas ducts 4, 5, which are provided with burner rings 16, 17. The diameter of the burner ring is substantially same as the diameter of the gas duct proper. Those gas ducts that are provided with a burner ring are advantageously also provided with a gas exhaust duct 18, which is mainly meant for emergencies. The sintered material 19 is removed from the belt for further processing. From the sintering, preheating and drying zones the gases are discharged to the exhaust conduits 20. From there, they are conducted to gas cleaning and possibly recirculated back to the sintering process.

Figure 2:
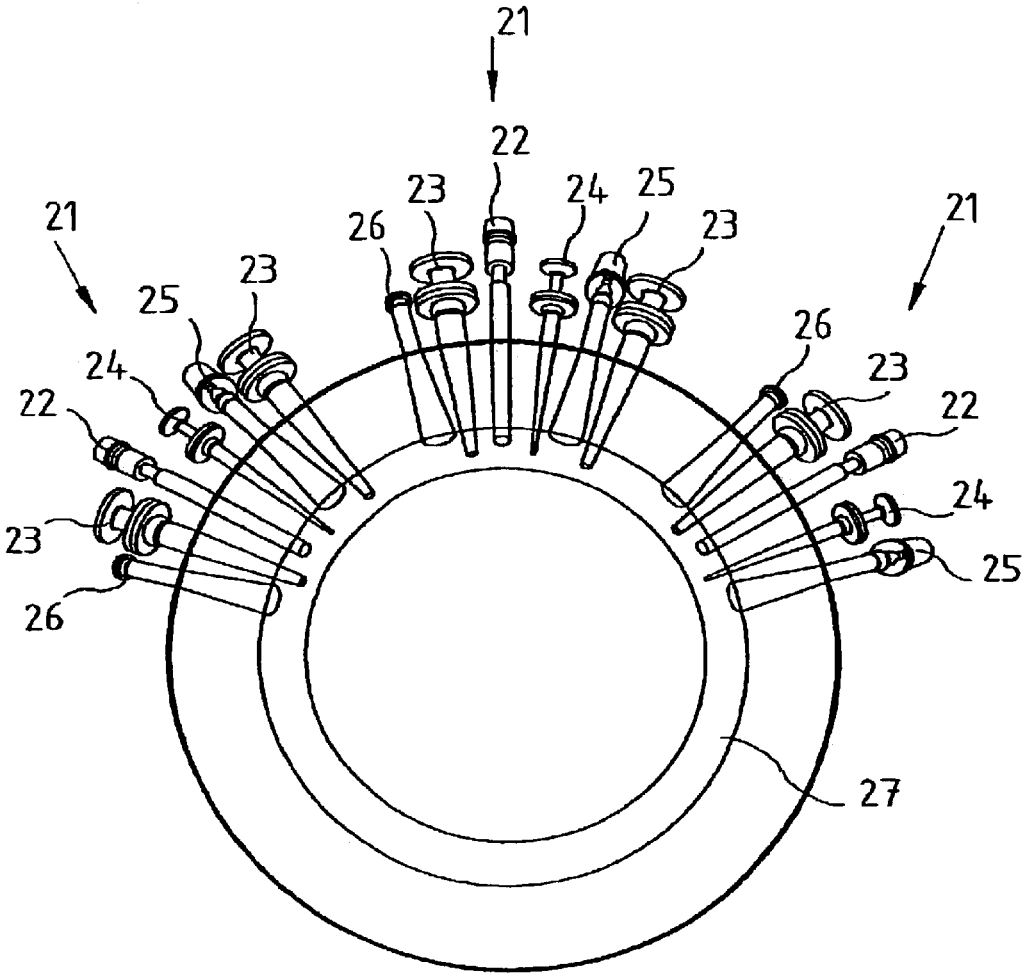
FIG. 2 is a vertical section of the gas circulation duct, seen at the burner ring.

In FIG. 2, there is shown an example of how the different burner units of the burner ring are placed on the circumference of the burner ring. With respect to each other, the burner units are placed in the top part of the ring at an angle of about 60 degrees, but the units can also be positioned on the circumference of the ring at an angle of 45–100 degrees with respect to each other. In the drawing it is seen that the ring burner comprises three burner units 21, but the number of the burner units may vary between 2–6. In the case of the drawing, each burner unit is provided with an ignition burner 22 placed in the middle thereof, and around said ignition burner, there are arranged the feed ducts of the various fuels, but naturally their locations may vary. In the arrangement according to FIG. 2, each unit is provided with at least one feed duct 23 for CO gas and one feed duct 24 for liquefied gas. In addition, each unit is provided with a flame guard 25 and an inspection opening 26, although they are not necessary in every burner unit of one and the same burner ring. The inspection opening is provided with fireproof glass. In this arrangement, combustion air need not be separately fed except to the ignition burner, which is used in the beginning of the heating process only. Otherwise the air needed in the combustion process is obtained from the gas flowing in the gas circulation ducts.

The feed ducts of the burner unit are mainly protected by the structures of the burner ring, and the ignition burner can be drawn completely inside the structure, when the temperature rises high enough. The employed fuels may vary according to what is most economic in each case. It is, however, advantageous—although not necessary—that the burner ring is provided with feed ducts for at least two different fuels. If for instance CO gas is temporarily not available, the employed heating gas can be liquefied gas etc. The end of the feed duct can be provide with a nozzle. The drawing also shows the inwardly directed protuberance 27 of the gas duct which protuberance is placed immediately before the burner units in the gas flowing direction. The protuberance makes the gas turbulent and enhances the mixing of the fuel with the gas.

Figure 3:
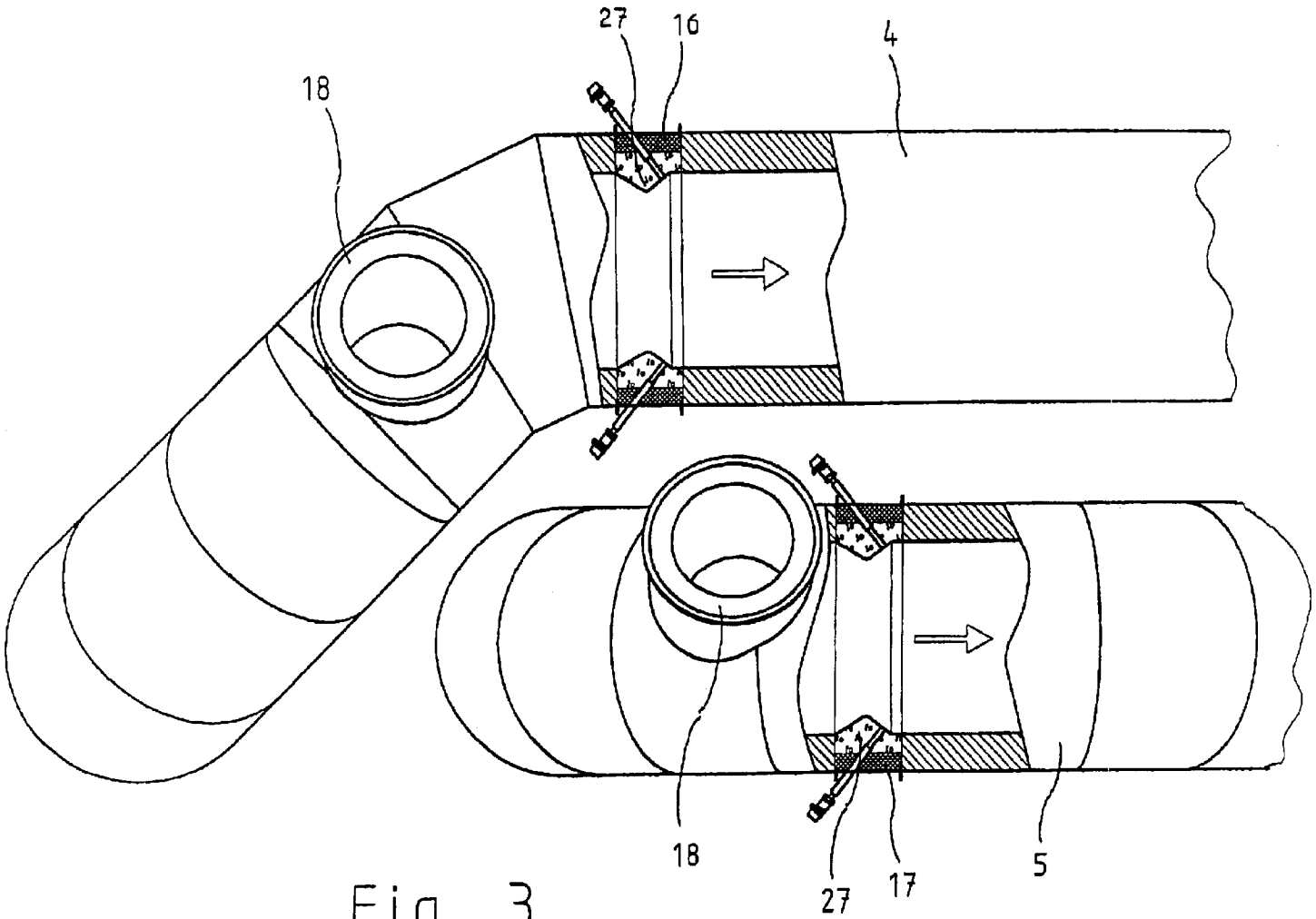
FIG. 3 is a top-view illustration of the gas duct, seen in partial cross-section at the burner ring.

In FIG. 3, there is shown the placing of the burner rings in the horizontal part of the gas ducts, in which case they are not in the immediate vicinity of the bed to be sintered. Likewise it is shown that the protuberance 27 placed near the burner units extends inwardly, so that at the protuberance, the inner diameter of the burner ring is 10–40% smaller than the inner diameter of the horizontal part of the burner ring and of the gas duct at other spots in the duct. The interior of the gas duct and the burner ring is made of a fireproof material, and it is not illustrated in more detail in the drawing.

What is claimed is:

1. An arrangement for heating gas in a gas circulation duct of a continuously operated sintering arrangement, wherein the sintering arrangement comprises a sintering furnace, a sintering belt rotating inside said furnace and at least one gas circulation duct from which the gas is fed through the sintering belt, a part of the gas circulation duct, placed above the sintering belt, being formed as a burner ring, said burner ring comprising at least two burner units directed inwardly from the circumference of the gas circulation duct, the burner units of the burner ring including at least one ignition burner.

2. An arrangement according to claim 1, wherein the burner ring is formed on the horizontal part of the gas duct.

3. An arrangement according to claim 1, wherein above the sintering belt, there are placed several gas circulation ducts, among which at least one is provided with a burner ring.

4. An arrangement according to claim 1, wherein the burner unit comprises a feed duct for at least one fuel.

5. An arrangement according to claim 1, wherein the burner unit comprises feed ducts for at least two different fuels.

6. An arrangement according to claim 1, wherein the feed ducts of the burner unit are mainly situated inside the structures of the burner ring.

7. An arrangement according to claim 1, wherein the ignition burner is provided with hydraulic control which can be drawn in.

8. An arrangement according to claim 1, wherein the burner units of the burner ring comprise at least one flame guard.

9. An arrangement according to claim 1, wherein the burner ring comprises 2–6 burner units.

10. An arrangement according to claim 1, wherein the burner units are placed in the burner ring at an angle of 45–100° with respect to each other.

11. An arrangement according to claim 1, wherein the burner ring is provided with a protuberance that is directed inwardly from the inner edge of the ring.

12. An arrangement according to claim 11, wherein at the protuberance, the inner diameter of the burner ring is 10–40% smaller than the inner diameter of the straight part of the gas duct.

13. A method for heating gas in a gas circulation duct in connection with continuously operated sintering, comprising feeding a material to be sintered as a bed onto a sintering belt which proceeds in a sintering furnace through at least a preheating and sintering zone into which gas is fed through the gas circulation ducts, heating gas in a burner ring of the gas circulation duct, placed above the sintering belt outside the furnace, up to a temperature of 1,000–1,600° C.; after the fuel used for heating has been ignited, obtaining the combustion air needed for burning from the gas flowing in the gas circulation duct, and feeding fuel in the burner ring at least from two burner units directed inwardly from circumference edges of the gas circulation duct.

14. A method according to claim 13, wherein the burner ring is located in the horizontal part of the gas circulation duct.

15. A method according to claim 13, further providing in each unit of the burner ring, a feed duct for at least one fuel.

16. A method according to claim 13, further providing in each unit of the burner ring, feed ducts for at least two different fuels.

17. A method according to claim 13, further mainly protecting feed ducts of the burner unit by the structures of the burner ring.

18. A method according to claim 13, further making the gases in the circulation duct turbulent and mixing them with the fuel by means of a protuberance arranged in the burner ring.

* * * * *